United States Patent [19]

Huber et al.

[11] 4,125,007

[45] Nov. 14, 1978

[54] PUNCH AND METHOD OF CONSTRUCTION

[75] Inventors: Joseph B. Huber, Acme; Andrew M. Marcinko, Mount Pleasant, both of Pa.

[73] Assignee: Kennametal Inc., Latrobe, Pa.

[21] Appl. No.: 847,171

[22] Filed: Oct. 31, 1977

Related U.S. Application Data

[63] Continuation of Ser. No. 725,186, Sep. 21, 1976, abandoned.

[51] Int. Cl.[2] ..... B21C 25/06

[52] U.S. Cl. ..... 72/273; 72/478

[58] Field of Search ..... 72/273, 209, 264, 266, 72/270, 478, 476, 477, 479; 29/526; 76/107 A, DIG. 11, 101 A

[56] References Cited

U.S. PATENT DOCUMENTS

| | | | |
|---|---|---|---|
| 1,471,605 | 10/1923 | Hoff et al. | 72/479 |
| 1,989,948 | 2/1935 | Singer | 72/264 |
| 2,388,273 | 11/1945 | Lord | 151/19 R |
| 3,893,776 | 7/1975 | Beattie | 29/526 |

OTHER PUBLICATIONS

"Designing with Kennametal"; Kennametal Inc., 1967; Chapter 4, pp. 22, 23.

*Primary Examiner*—Michael J. Keenan
*Attorney, Agent, or Firm*—Lawrence R. Burns

[57] ABSTRACT

A punch for working material, such as an extrusion punch, wherein a hard wear resistant material is joined on one end to a rigid body, preferably a steel punch. The hard wear resistant material is joined on at the tip of the rigid body so as to prevent wear due to abrasion on the punch caused by the material being worked. The hard wear resistant end cap on the tip of the steel body is joined so that it may easily and quickly be replaced when the punch is in position on the machine thereby providing less down time for maintenance on the extrusion press. The method of joining the hard wear resistant end cap to the steel body minimizes the conditions which tend to fracture hard wear resistant material.

3 Claims, 4 Drawing Figures

PUNCH AND METHOD OF CONSTRUCTION

This is a continuation of application Ser. No. 725,186, filed Sept. 21, 1976, now abandoned.

BACKGROUND OF THE INVENTION

When working material, such as in an extrusion press, a punch member and a die member are utilized such that material to be extruded is placed in a die member and an extrusion punch powered on one end by a force transmitting mechanism is caused to enter the die means, and by compressing the material in the die means, the material flows under pressure into a desired end.

Specifically, in a back extrusion process, the die means is closed on the lower end, and there is sufficient clearance between the inside diameter of the die means and the outside diameter of the punch such that, when the material to be extruded is compressed, it flows axially into the clearance provided between the punch and the die means.

Most punches of the prior art have been formed of a hardened steel material in order to transmit the force required for deformation of the material to be extruded. A steel punch used in a back extrusion process usually has a uniform diameter throughout its length except for the end of the punch which first enters the die means, and this end is provided with a slightly larger diameter such that, when the material that is being extruded flows outward and around the enlarged end of the punch, it will not contact the outer surface of the punch which it surrounds. This is done so that the punch may be extracted from the die means without the extruded material being engaged to the punch.

The material that is extruded is sometimes extruded at an elevated temperature or has heat imparted to it from its mechanical deformation such that, if the extruded material were to stay with the punch as it was retracted from the die means, the immediate cooling of the extracted material would cause it to contract and serious problems would then arise in having to remove the extruded material from the punch before any further extruding would be possible.

One of the problems that arises when using a punch made of a steel material is that, after a certain period of use, the slightly enlarged diameter of the punch is severely galled or worn down due to abrasion of the material as it flows around corners of the punch. When that diameter is worn down, there is no clearance between the extruded material and the diameter of the rest of the punch body and the extrusion punch must then be removed and replaced in order to continue the extrusion operation.

Certain other configurations and methods of construction of extrusion punches and the like have been described in applicants' copending U.S. patent application Ser. No. 644,642, filed Dec. 29, 1975, entitled "EXTRUSION PUNCH AND METHOD OF CONSTRUCTION."

It is an object of the present invention to provide a hard wear resistant material on the tip of the extrusion punch that will significantly outlast any of the steel materials presently used on such extrusion machines.

It is a further object of the present invention to make the hard wear resistant tip easily and quickly replaceable so as to minimize down time required for maintenance on the extrusion machine.

It is a further object of the present invention to join the hard wear resistant material to the already existing steel extrusion punch in such a manner so as to take advantage of the compressive strength of the hard wear resistant material.

It is a further object of the present invention to provide a simple, efficient, easily replaceable mechanical connection between a hard wear resistant material and a rigid body such as a steel body.

BRIEF SUMMARY OF THE INVENTION

According to the present invention, a punch for either cold working or hot working of materials is presented and the method of making the punch is also described.

The punch according to the present invention is comprised of a rigid elongate body, preferably made of a steel material, an end cap of hard wear resistant material, which is preferably a cemented hard metal carbide material, and a split ring element, which is interfitted between the rigid elongate body and the end cap, so as to provide a solid connection between the rigid elongate body and the end cap.

The rigid elongate body is preferably cylindrical in nature, having one end adapted for connection to a reciprocal force terminating source. The other end of the rigid elongate body has a threaded aperture formed therein, preferably along the central axis when the rigid elongate body is cylindrical in nature.

An end cap of a hard wear resistant material, preferably formed from a cemented hard metal carbide material, such as tungsten carbide, is provided and has at least one face portion for engagement with material that is either to be cold or hot worked.

A second face is provided on the end cap, preferably having regions on the second face for abutment with the apertured end of the rigid elongate body and a reduced diameter portion extends for a predetermined distance from the second face, the diameter tapering outwardly toward the free end thereof. A flat portion is provided on the reduced diameter portion which extends along the length thereof and has its widest dimension at the free end of the reduced diameter portion and tapers inwardly toward the second face of the end cap.

A ring element is provided, preferably having a uniformly threaded outside diameter designed to mate with the threaded aperture of a rigid elongate body, and having an inside diameter provided with a taper designed to register with and provide a close fit with the taper provided on the reduced diameter portion of the end cap.

A second flat portion is provided on the ring element corresponding in approximately the same shape and size to the flat portion provided on the reduced diameter portion. When the ring element is formed with these features thereon, the ring element is split longitudinally along its center line, preferably in approximately equal proportions. The split ring elements so produced can then be assembled over the reduced diameter portion of the end cap, and both the split ring elements and the end cap may then be threaded into the aperture provided in the rigid elongate body.

Once the initial threads are engaged between the split ring elements and the reduced end cap and the threaded aperture on the rigid elongate body, the corresponding flat portions between the reduced diameter portion and at least one of the split ring elements prevents rotation of the split ring elements upon the reduced diameter portion.

Since rotation as mentioned above is prevented, the end cap may be rotated and threadedly advanced into the apertured end of the rigid elongate body are in firm abutment with one another.

The exact nature of the present invention will become more clearly apparent upon reference to the following detailed specification taken in connection with the accompanying drawings in which.

DETAILED DESCRIPTION OF THE INVENTION

Figure 1:
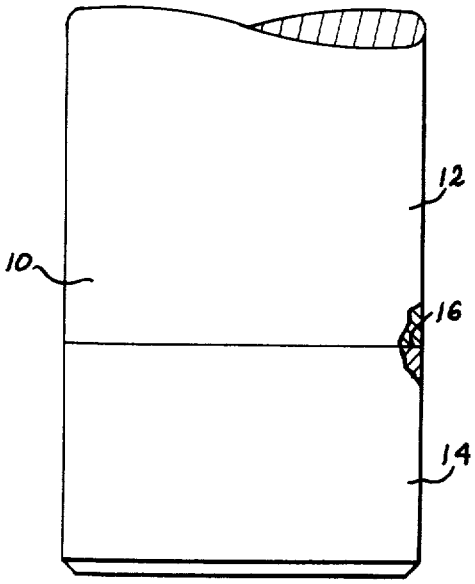
FIG. 1 is a side view of a punch according to the present invention.

Referring to the drawings somewhat more in detail, according to FIG. 1, a punch 10 is shown constructed having a rigid elongate body 12 preferably made of a steel material and configured so as to be cylindrical in plan. An end cap 14 is provided, preferably made from a cemented hard metal carbide, such as tungsten carbide. According to the present invention, the end cap 14 is held in firm abutment with rigid elongate body 12 as is shown at 16 in FIG. 1.

Figure 2:
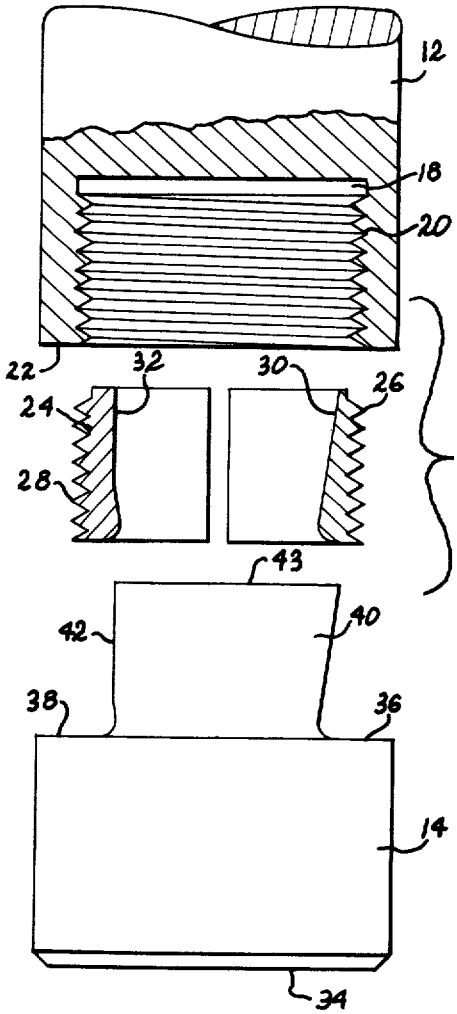
FIG. 2 is a side cut-away view of the punch shown in FIG. 1.

Referring now to FIG. 2, what is shown therein is a rigid elongate body 12 having an aperture 18 formed therein with the aperture 18 provided with threads 20 extending inwardly from one end of the rigid elongate body 12. Rigid elongate body 12 has a peripheral abutment surface indicated at 22 providing one of the cooperating elements of abutment shown at 16 in FIG. 1.

Split ring elements 24 and 26 are shown in FIG. 2 with both ring elements being formed from a single ring having outside threads 28 formed thereon and designed to mate with the threads 20 in aperture 18.

Each of the split ring elements 24 and 26 are provided with a tapered surface 30. In addition, at least one of the split ring elements 24, 26 is provided with a flat 32 on its inside diameter.

End cap 14 is shown in FIG. 2, with end cap 14 having at least one face 34 thereon for working or forming cold or hot materials. A second face 36 is provided on end cap member 14 and having a peripheral portion 38 which forms one of the cooperating elements of abutment shown in FIG. 1 at 16. Extending from second face 36 is a reduced diameter portion 40 extending outwardly for a predetermined distance and tapering outwardly toward the free end 43 of reduced diameter portion 40.

Reduced diameter portion 40 is provided with a flat 42 thereon which will correspond approximately in shape and size with the flat 32 produced on at least one of the ring elements 24 or 26.

Preferably, the longitudinal length of the split ring elements 24 and 26 will be less than the longitudinal length of the aperture 18 formed in the rigid elongate element 12.

Figure 3:
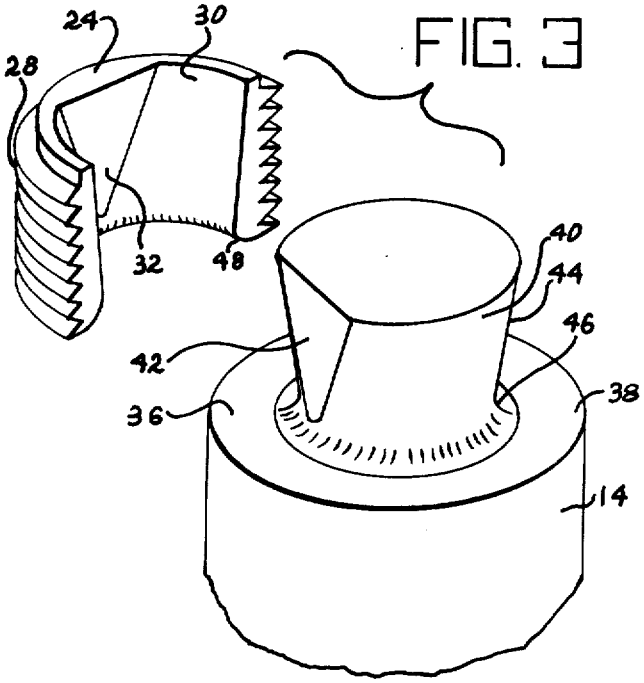
FIG. 3 is a perspective view of an assembly detail of the punch according to the present invention.

Referring now to FIG. 3, what is shown therein is split ring element 24 having threads 28 formed on its outside diameter and having a tapered inside diameter 30 with the tapered inside diameter 30 designed to closely fit and register with the tapered outside diameter 44 of reduced diameter portion 40. The flat 32 is shown on the inside diameter of the split ring element 24 and is configured in shape so as to register with the flat 42 shown on the reduced diameter portion 40.

The flat 42 shown on reduced diameter portion 40 is preferably shaped so as to have its widest dimension at the free end of the reduced diameter portion 40 and tapers inwardly toward the second face 36 of the end cap member 14.

The juncture of the reduced diameter portion 40 and the second face 36 is provided with a radius 46 so as to prevent sharp corners and stress risers on the end cap member 14. A split ring element 24 is provided also with a radiused portion 48 configured and shaped so as to closely fit with the radiused portion 46 on end cap member 14.

Figure 4:
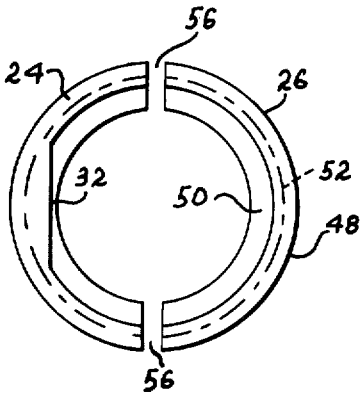
FIG. 4 is a plan view of the split ring elements used to assemble the punch according to the present invention.

Referring now to FIG. 4, what is shown therein is a plan view of the split ring elements 24 and 26. As can be seen by FIG. 4, split ring elements 24 and 26 are produced by first forming a solid ring having a uniformly threaded outside diameter 48 and a tapering inside diameter 50. As is shown in FIG. 4, the tapering inside diameter 50 tapers inwardly in the direction of the paper.

Threads 52 are shown at dot-dash line around the uniform diameter 48. The flat 32 is shown formed on at least one of the split ring elements 24, 26. As can be seen by viewing FIG. 4, a solid ring having the desired threads on the outside diameter and the appropriate taper around the inside diameter and the required flat 32 on either one of split ring elements 24 and 26 may be formed in a solid ring and then a longitudinal cut 56 may be made through the solid ring element thereby producing split ring elements 24 and 26.

Shown in FIG. 4, the split ring elements 24 and 26 are, preferably, symmetrical about the cut 56 and, therefore, are, preferably, of approximately equal size to each other. The split metal ring according to FIG. 4 is, preferably, made from an easily machineable material and is, preferably, in this particular invention, made from a heavy tungsten material designated by the trade name KENNERTIUM.

The configuration on the inside diameter of the ring is preferably formed by EDM methods.

Modifications may be made within the scope of the appended claims.

What is claimed is:

1. An extrusion punch comprising; a rigid elongate body having one end adapted for connection to a reciprocal force transmitting source, a threaded aperture formed axially into the other end of said body; an end cap formed of a cemented hard metal carbide having a working region facing away from said body and having an annular abutment region facing said body for abutment with said other end of said body; a reduced diameter portion on said end cap extending into said threaded aperture and tapering outwardly away from said end cap; an internally threaded two part split ring element mating with the threads of said aperture and tapered internally for mating with said tapered reduced diameter portion of said end cap, and radially inwardly and outwardly facing mating axial flats formed respectively on the inside of said split ring and on the periphery of said reduced diameter portion of said end cap so as to prevent rotation of said split ring element on said reduced diameter portion of said end cap.

2. A forming punch according to claim 1 in which said rigid elongate body is comprised of a steel material.

3. A forming punch according to claim 1 in which said cemented hard metal carbide comprises tungsten carbide.

* * * * *